United States Patent [19]

Kemlo

[11] Patent Number: 5,073,104

[45] Date of Patent: Dec. 17, 1991

[54] FLAME DETECTION

[75] Inventor: Kenneth G. Kemlo, Lambton, Australia

[73] Assignee: The Broken Hill Proprietary Company Limited, Melbourne, Australia

[21] Appl. No.: 410,212

[22] Filed: Sep. 21, 1989

Related U.S. Application Data

[63] Continuation-in-part of Ser. No. 339,867, Apr. 17, 1989, abandoned, which is a continuation of Ser. No. 61,343, May 11, 1987, abandoned.

[51] Int. Cl.[5] ..... F23D 5/12

[52] U.S. Cl. ..... 431/12; 431/13; 431/50; 431/25; 431/78; 328/6; 340/579

[58] Field of Search ..... 431/12, 13, 25, 50, 431/59, 78; 328/6; 340/579

[56] References Cited

U.S. PATENT DOCUMENTS

| | | | |
|---|---|---|---|
| 2,003,624 | 6/1935 | Bower | 431/50 |
| 2,407,517 | 9/1946 | Ray | 431/80 |
| 2,511,177 | 6/1950 | Richardson | 431/13 |
| 2,870,329 | 1/1959 | Aubert | 431/25 |
| 2,903,052 | 9/1959 | Aubert | 431/50 |
| 3,034,571 | 5/1962 | Matthews | 431/80 |
| 3,302,685 | 2/1967 | Ono et al. | 431/13 |
| 3,699,905 | 10/1972 | Gach et al. | 431/80 |
| 4,107,657 | 8/1978 | Nishigaki et al. | 340/579 |
| 4,672,324 | 6/1987 | Kampen | 431/25 |
| 4,859,171 | 8/1989 | Altemark et al. | 431/12 |

*Primary Examiner*—Carroll B. Dority
*Attorney, Agent, or Firm*—Armstrong, Nikaido, Marmelstein, Kubovcik & Murray

[57] ABSTRACT

A method and apparatus of detecting the condition of a flame having an emf by electrically conducting the emf generated by the flame as a signal to a sensor through an electrically isolated conductor means and sensing with said sensor an electrical parameter which is measure of the emf of the flame and wherein the parameter is the ratio of the A.C. and D.C. signal levels.

13 Claims, 4 Drawing Sheets

FIG. 1
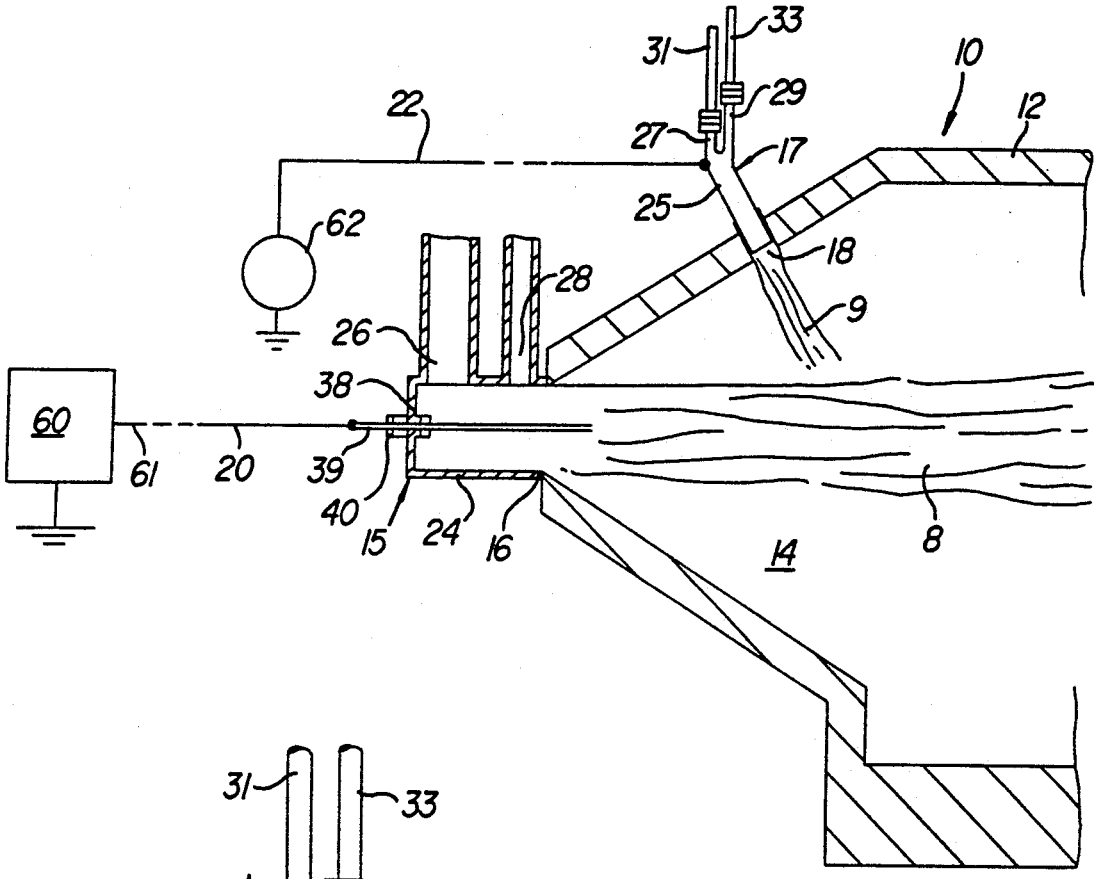
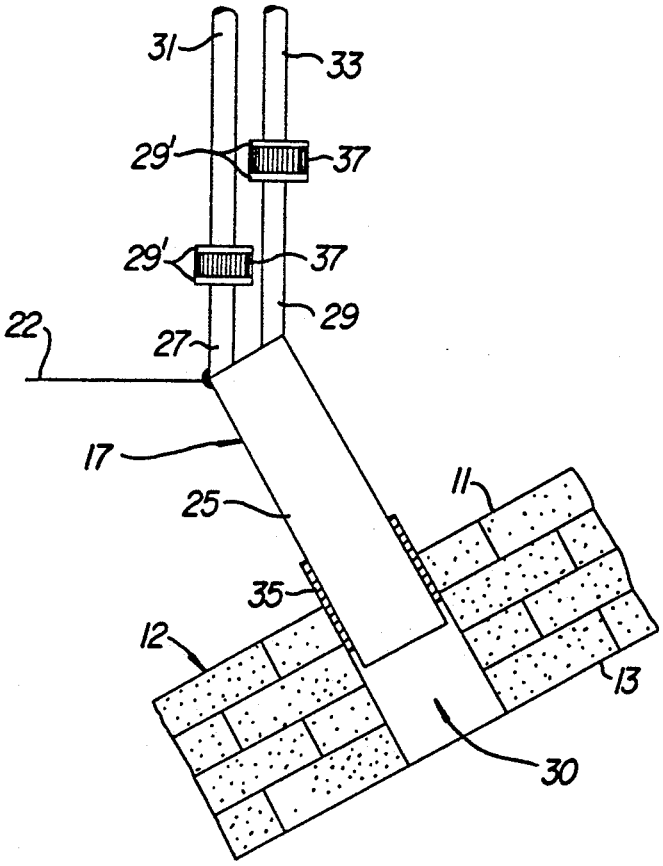
FIG. 2

OUTPUT
SIGNAL RATIO
AD534 ANALOGUE MULTIPLIER
68
79
60
D.C. CONVERSION
IDEAL RECTIFIER CIRCUIT
78
D.C. SIGNAL AMPLIFICATION
A.C. SIGNAL AMPLIFICATION
100K
LM741
66
76
1K
5K6
10K
65
LOW PASS FILTER
HIGH-PASS FILTER
10uF
150K
63
64
74
61a
61b
INPUT SIGNAL

FLAME DETECTION

This application is a continuation-in-part of application Ser. No. 339,867, filed Apr. 17, 1989 and now abandoned, which was a continuation of Ser. No. 061,343, filed May 11, 1987 and now abandoned.

FIELD OF THE INVENTION

The present invention relates to the detection of the condition of a flame, for example a flame of a burner The term "condition" in this context embraces the presence or absence of the flame, or more generally a state of the flame indicating the state of combustion at the flame.

The unscheduled extinction of the flame of a burner results in a mixture of unburnt gases entering the combustion chamber This is highly undesirable as any subsequent ignition of the unburnt mixture is potentially hazardous to both personnel and equipment.

BACKGROUND ART

There are two methods commonly used for detecting flame failure in burner systems associated with furnaces. In general, such burner systems comprise a main burner and a pilot burner, the pilot burner being provided since it is an efficient method for igniting the fuel-air mixture from the main burner.

The first method is based on the use of an alloy rod (usually a high nickel, chromium, iron alloy) known as a "flame rod" that is inserted into the front end of the main burner and extends into the combustion space. A voltage supply (typically 120 volts A.C.) is applied to the rod and the electrical conductivity to the earth potential via the flame is measured Since the flame is capable of partially rectifying an alternating current, flame failure can be detected by the absence of rectification in the applied current between the flame rod and the earth potential.

There are several disadvantages associated with the use of flame rods and these may be summarized as follows:

(a) Flame rods are subject to oxidation and corrosion in the high temperature environment existing within the furnace. Such deterioration is accelerated by the fact that the flame rod must be positioned to extend into the high temperature region of the flame.

(b) Rectification measurements must be carried out accurately since electrical conductivity of the hot refractories between the flame rod and the earth generally is very significant. The extent of rectification is the component of a total signal which must be identified in order to positively identify that a flame connection exists in the high voltage circuit being monitored.

(c) In situations where a furnace comprises a number of relatively closely spaced burners it can be difficult to be certain that measurements relate to the burner near the location of the flame rod.

(d) A power supply is necessary to drive the measuring circuit and an electronic circuit capable of detecting the extent of rectification is required.

The second known method for detecting flame failure in burner systems in furnaces is based on the use of an optical device to sense the presence of a flame. An entry port or sighting hole is provided in the main burner cowl and is fitted with an optical device which focuses the light emanating from the flame. The light is focused onto a photosensitive element so that the wavelength in the blue to ultra-violet range is measured by filtering in order to detect light from the flame rather than from the incandescent contents of the furnace.

Light detection devices have the following limitations:

(a) The devices do not sense some flames satisfactorily (in particular those fed by natural gas and other relatively non-luminous combustion mixtures).

(b) The devices are difficult to align with the correct area of the flame.

(c) Often, it is necessary to turn off the pilot flame in order to ensure that the main burner flame is being sighted and therefore proved.

(d) Vibration of the furnace and related equipment often causes difficulties in proper aligning of the devices.

A third approach, in which an applied current is conducted via the principal burner flame and an auxiliary flame such as the pilot flame, is the basis of flame monitoring circuits disclosed in U.S. Pat. Nos. 2,003,624 to Bower and 2,903,052 to Aubert. The Bower patent describes an arrangement to which an electrode from the grid of a glow tube contacts the pilot flame, which in turn intersects the grounded main flame. Flame failure interrupts the circuit and results in de-energization of a relay coil. Aubert describes a monitoring arrangement in which an electrically isolated pilot burner conducts an applied emf via its flame, a main burner flame and an ignition pilot burner in a detection circuit.

The application of an external voltage to a flame relies on the associated electrical conductivity through the flame to keep the flame in a "proved state". However, flame fluttering due to varying flame positions and swirling in burner systems cause the measured conductivity—which is all that can be measured once an applied voltage is impressed onto the system—to fluctuate considerably. Significant delays e.g. 2 to 4 seconds, must be built into the detection/alarm circuits to avoid false alarms due to the conductivity temporarily falling below a particular threshold level, but such delays often represent the entry of a large quantity of unburnt fuel into the burner with the attendant high risk of explosion. Systems with an applied voltage are also susceptible to false alarms since corrosion of the pilot burner tips and of the flame rods ultimately increases the electrical resistance between the sensor and the flame. Buildups of carbon, ash and other materials interfere with optical methods and also deposit on tips and rods, thus lowering their sensitivity and rendering the measuring circuit unpredictable.

U.S. Pat. No. 3,302,685 to Ono proposes a flame detection arrangement based on the observations that the natural electrical phenomena associated with chemical reactions and temperature differences within a flame result in an electromotive force (emf) in the flame, and that this emf can be monitored, for example, by means of an isolated electrical conductor in contact with the flame to provide an indication of the condition of the flame. Ono's arrangement has the advantage that no high voltage source is required and entails detection of the flame condition with a simple voltmeter in a circuit including the flame and an electrode in contact with the flame. Electrode degradation is a problem with this proposal, and the method also suffers from the fact that conductivity is effectively being measured, necessitating, as before, a significant delay time to avoid serious flame-out recordals.

SUMMARY OF THE INVENTION

It is an object of the invention to provide a method and apparatus for detecting the condition of a flame which achieves reliable detection of flame failure with simple circuitry and a response time better then heretofore achieved.

The invention accordingly provides a method of detecting the condition of a flame comprising the steps of:

establishing a flame having an emf;

electrically conducting the emf from the flame as a signal to a sensor through electrically isolated conductor means; and sensing with said sensor an electrical parameter which is a measure of said emf of the flame;

wherein said electrical parameter is a parameter selected for its intrinsic dependence on the presence of the flame and the substantial independence of its value from the connectivity of the flame with the conductor means and from the amplitude of the signal received at the sensor.

The invention also provides a furnace assembly including a housing forming a combustion chamber, means for defining a flame position in the chamber, first burner means for generating said flame, electrical conductor means in electrical contact with said flame during operation of the furnace assembly, and means for electrically isolating said electrical conductor means, the improvement comprising:

means coupled to said electrical conductor means for monitoring an electrical parameter which is a measure of said flame emf generated by said flame, said flame emf being indicative of the condition of the flame, wherein said electrical parameter is a parameter selected for its intrinsic dependence on the presence of the flame and the substantial independence of its value from the connectivity of the flame with the conductor means and from the amplitude of the signal received at the sensor.

A sharp change in the value for the monitored parameter (compared with background levels associated with the furnace) will indicate that a flame has been extinguished.

Said parameter may e.g. be the ratio of the A.C./D.C. signal levels, or the electrical frequency spectral distribution of the various flame oscillation components.

The electrical conductor means may conveniently comprise an elongate conductor projecting into the flame through an electrically insulated aperture in the housing. This conductor may project a distance sufficient to electrically contact a cool part of the flame, but insufficient to reach the hotter parts of the flame and furnace interior during normal operation of the burner.

Conveniently where it is applicable, the electrical conductor means may comprise an auxiliary flame in electrical contact with the flame whose condition is being detected. The emf may then be monitored by simply measuring the voltage between the two burners. This technique is especially applicable where the furnace includes a plurality of burners, e.g. a main burner and a pilot burner, positioned such that the flames from the burners contact each other.

As already foreshadowed, the present invention may be employed in the control of oxidant-fuel ratio (stoichiometry) during the flame combustion process. It has been observed that the mean D.C. level of the emf being monitored at a given stoichiometry changes when the ratio of fuel to oxidant is altered. If both fuel and oxidant are altered to maintain a given relationship to each other the voltage does not change significantly. By monitoring the D.C. voltage level, the combustion of the burner gases, and therefore the furnace oxidation state, can be kept within desired limits. In most applications where air is the oxidant, close control of the air-fuel ratio is therefore possible by continuously monitoring the voltage level, or a related parameter, in accordance with the present invention and adjusting either the air supply or fuel supply so that the voltage level is maintained constant.

BRIEF DESCRIPTION OF THE DRAWINGS

A detailed description of preferred embodiments of the present invention will now be provided by way of example only, with reference to the accompanying drawings, in which:

FIG. 1 is a schematic sectioned view of a first embodiment of a furnace assembly in accordance with the invention, in which the states of the main burner and pilot flame are separately monitored;

FIG. 2 schematically depicts in greater detail the structure of the pilot burner of the furnace assembly shown in FIG. 1;

BEST MODE(S) OF PERFORMANCE

Figure 3:
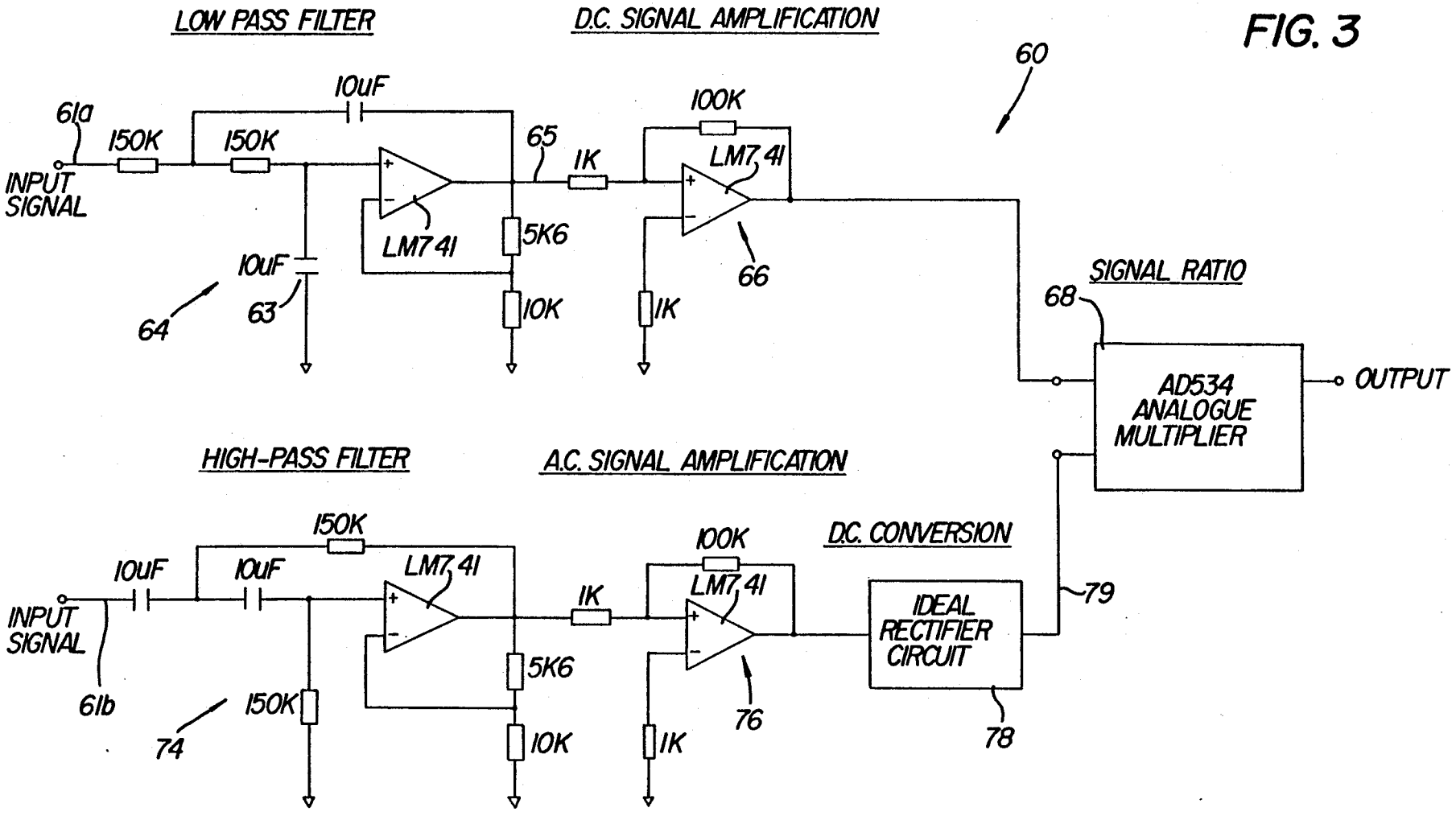
FIG. 3 is a block electrical circuit diagram of the flame condition detection circuit forming part of the assembly depicted in FIG. 1.

The furnace assembly 10 shown in FIGS. 1 and 2 includes a refractory brick wall housing 12 forming a combustion chamber 14; respective apertures 16, 18 in housing 12, defining main flame and pilot flame positions; a main burner 15 and pilot burner 17 mounted respectively in apertures 16, 18; and separate electrical leads 20, 22 for detecting the condition of each flame. Leads 20, 22 respectively conduct a signal to a flame condition detection circuit 60 and to an amplifier or voltmeter 62.

The main burner 15 comprises a suitable metallic casing 24 formed with separate inlet ports, 26, 28 for delivering air and fuel gas to the interior of the casing. Similarly, the pilot burner 17 comprises a metallic casing 25 formed with separate air and gas inlet ports 27, 29 coupled to respective supply pipes 31, 33. As best seen in FIG. 2, pilot burner 17 is positioned towards the outer surface 11 of refractory wall 12 so that the space between the pilot burner 17 and the inner surface 13 of the refractory wall 12 defines a port 30.

As is the usual practice the main burner 15 and housing 12 are electrically connected to ground. On the other hand, as can best be seen in FIG. 2, pilot burner 17 is electrically isolated by separating the front section of casing 25 from housing 12 by means of a wrapping 35 of asbestos or glass fiber materials, and by positioning insulation 37 between the flanges 29' forming the connection between the air and gas inlet ports 27, 29 and the respective air and gas supply pipes 31, 33.

It will be understood that pilot burner 17 thereby constitutes electrically isolated electrical conductor means in electrical contact with the pilot flame. It is less practicable to similarly isolate the main burner and accordingly like means for the main burner flame comprises an elongate flame front conductor or electrode 39 that projects through an aperture 38 in the rear of the main burner 15 and is positioned to extend through the interior of casing 24 into the combustion chamber to contact the flame from the main burner 15 when there is a flame.

Electrode 39 is electrically isolated by insulation sleeving 40 in aperture 38.

In use and in the manner already explained, if the main burner is operating with a flame 8 extending into the interior of the furnace from main burner, the flame 8 will generate a randomly fluctuating emf. In a similar manner, pilot flame 9 will generate a second emf. A simple flame monitor may thereby consist of a voltmeter in series connection with the flame and this approach is depicted for pilot flame 9, utilizing amplifier or voltmeter 62. The emf of pilot flame 9 is indicated by a significant reading on amplifier or voltmeter 62. Failure of the flame will be immediately reflected by at least a substantial fall in this reading below a predetermined level monitoring of the natural flame emf is thus an effective technique for detecting the presence or absence of the flame. However, if this simple voltage measurement approach is applied to main flame 8, the signal fluctuates widely with varying connectivity to electrode 39 as the flame flutters and thus, in accordance with one aspect of the invention, circuit 60 is provided (FIG. 3) to sense an electrical parameter which is a measure of the emf but is also a parameter selected for intrinsic dependence on the presence of the flame and the substantial independence of its value from the connectivity of the flame with the conductor means or and from the amplitude of the signal received at the sensor.

The exemplary parameter sensed by circuit 60 is the ratio of the A.C. and D.C. signal levels at the circuit input 61. FIG. 3 details the circuit by way of a block diagram. The sensed signal is input from input 61 at 67*a* to a low-pass filter 64 in which 10 $\mu$F capacitor 63 shunts AC components to ground. The resultant DC component of the signal at 65 is amplified at 66 and fed to signal comparator 68. The sensed signal is also input from input 61 at 61*b* to a high-pass filter 74 which passes only the AC component via an amplifier 76 for rectification in an ideal rectifier circuit 78. The DC output at 79 is fed to device 68, which is an analogue multiplier configured to output the ratio of the two input components, i.e. the AC/DC ratio. A suitable device for comparator 68 is an Analogue Devices multiplier AD534.

Figure 4:
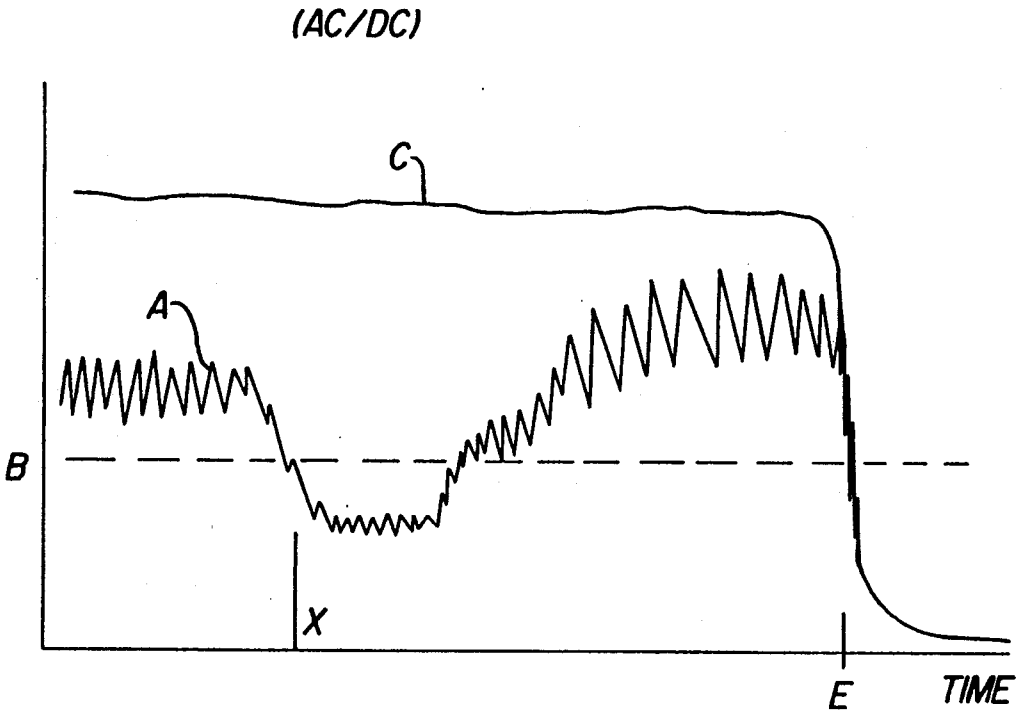
FIG. 4 is a graph illustrating the principles of the invention.

The effect of monitoring the AC/DC ratio instead of simple emf is demonstrated by the example depicted graphically in FIG. 4. Curve A is the simple emf case, B the alarm threshold level, and C the AC/DC ratio. The older technique would have triggered a false alarm at X but no such event would have occurred with the method of the invention, which nevertheless correctly detected flame failure by virtue of the sharp change in value at E. As seen from curve A, the amplitude of the AC component is proportional to the DC component. As the DC level dips at X, both the AC and DC amplitudes diminish in proportion to each other and hence the false alarm dip is eliminated in the ratio curve C.

Figure 5:
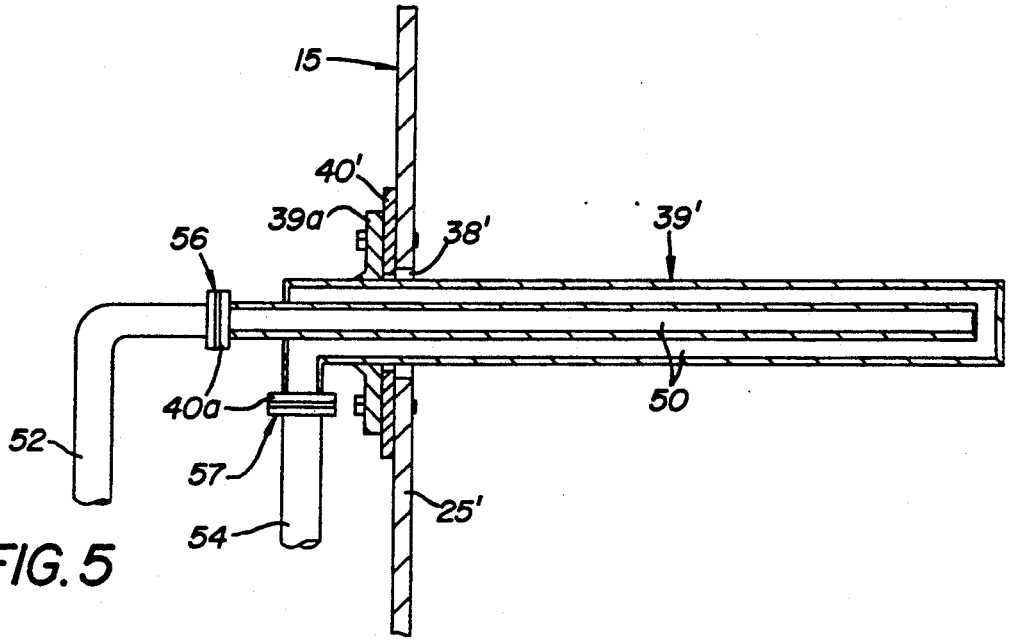
FIG. 5 is a schematic sectioned view of a modified form of elongate probe for use with the main burner of the furnace assembly shown in FIG. 1.

In general, conductor 39 need only extend a distance sufficient to electrically contact a cool part of the flame 8 and need not reach the hotter parts of the flame during normal operation of the main burner. In this manner, it is possible to avoid the corrosion problem discussed earlier in connection with prior art flame probes. Significant, cooling of the rod occurs by virtue of unburnt ambient temperature gases that are forced from the burner past the rod into the interior of the furnace. However, in some burners greater versatility may be desirable, especially where large changes are made to the total volume of combustion components entering the burner system. FIG. 5 thus illustrates a modified conductor 39' provided with concentric passages 50 for circulating substantially non-conductive coolant fluid (e.g. fresh water) through the interior of the conductor from a supply pipe 52 to a drain pipe 54. An insulating gasket 40' is provided at burner casing aperture 38' under a flange 39*a* on the conductor 39', and further insulating gaskets 40*a* are sandwiched in flange mountings 56, 57 for pipes 52, 54.

Figure 6:
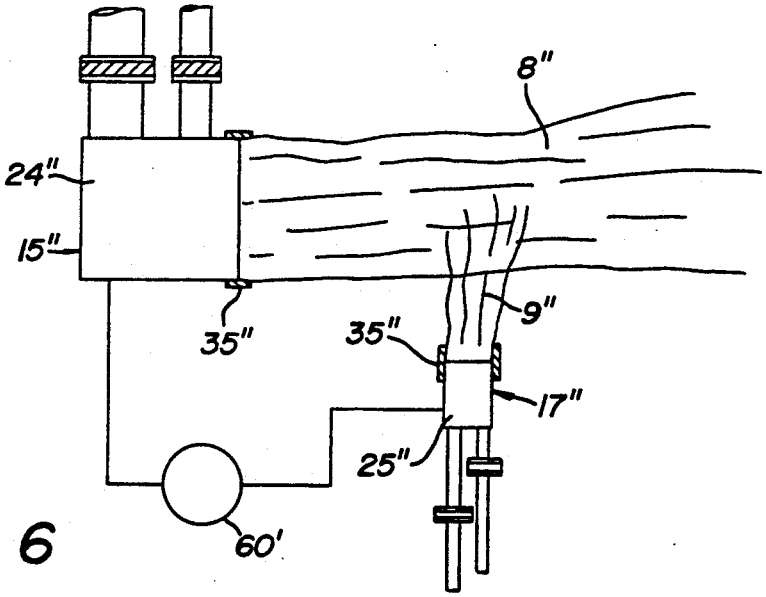
FIG. 6 is a schematic sectioned view of a second embodiment of furnace assembly in accordance with the invention, in which the pilot flame is utilized as electrical conductor means in electrical contact with the main burner flame.
Figure 7:
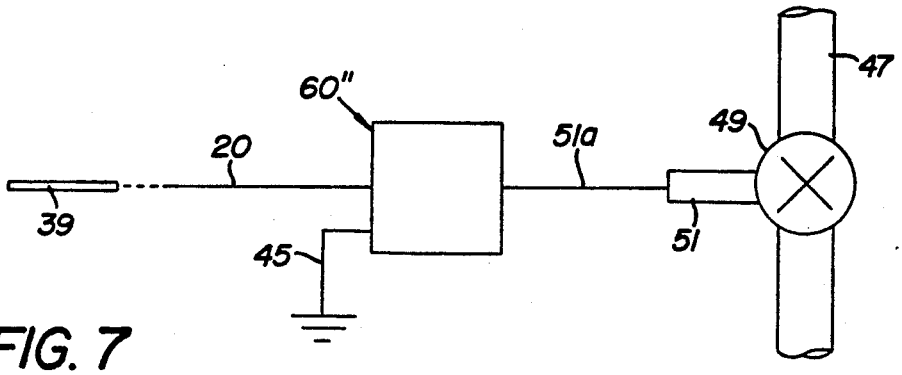
FIG. 7 is a block electrical circuit diagram of an arrangement for directly controlling fuel supply to the main burner of a furnace in response to the monitored flame emf.

In situations where the main burner 15 and the pilot burner 17 are positioned so that the flames from the burners contact each other, an alternative method for detecting the presence or absence of the flames can be used and is depicted in FIG. 6, which shows how the pilot flame 9'' provides a conductor in contact with the main flame 8'' and thus completes a conductive path between the main burner 15'' and the pilot burner 17''. The measurement of the voltage between these two points by circuit 60' will thereby provide an indication as to whether or not the flames are alight. As shown in FIG. 6, the main burner 15'' itself provides the electrical connection with the main flame and it must therefore be electrically isolated As an alternative to this arrangement, an elongate conductor such as conductor 39 of FIGS. 1 to 3 may be used to provide the electrical connection between the main flame and the circuit 60'. In a still further alternative arrangement, burner 15 is isolated and the pilot flame, or any other secondary flame, simply provides the required electrical conductor means in contact with the flame whose condition is being monitored FIG. 7 is a diagram of an electrical circuit for enabling control of the fuel supplied to the main burner 15 in response to the flame detection apparatus of FIGS. 1 to 3.

In this arrangement, the lead 20 from the flame front conductor 39 is connected to a control circuit 60'' which is grounded at 45 and which is capable of producing a signal indicative of mean DC value of the flame emf, which has been found to relate to the fuel-to oxidant ration. The fuel inlet port 28 is coupled to a fuel supply line 47 which is fitted in turn with a variable-flow valve 49 controllable by a solenoid 51. Circuit 60'' compares the monitored D.C. emf level with respective set points and if necessary transmits a control signal on line 51*a* to the solenoid 51 to adjust the valve 49 and thereby the fuel to air ratio. Where the D.C. level falls below the predetermined value or by the predetermined change indicative of flame failure, the control circuit closes valve 49 to shut off the fuel supply. A second control valve may of course be provided in the air supply line.

Table 1 sets forth the monitored voltage as a function of time as the oxygen pressure was altered in the feed to an acetylene-oxygen pressure was altered in the feed to an acetylene-oxygen flame. The conductor in electrical contact with the flame was a propane-oxygen flame of diffusion type.

TABLE 1

| Period | Press. $O_2$ (kpa) | Press. $C_2H_2$ (kpa) | Ratio $O_2/C_2H_2$ | Relative Voltage Level | Comments |
|---|---|---|---|---|---|
| A | 350 | 50 | 0.935 | 18.0 | Excess acetylene |
| B | 350 | 50 | 0.935 | 0 | Input shorted to determine zero level |
| C | 350 | 50 | 0.935 | 18.0 | Excess acetylene |
| D | 500 | 50 | 1.118 | 36.0 | Excess oxygen |
| E | 450 | 50 | 1.060 | 30.9 | Excess oxygen |
| F | 400 | 50 | 1.000 | 25.2 | Stoichiometric |
| G | 350 | 50 | 0.935 | 18.5 | Excess acetylene |

The advantages of the present invention may be summarized as follows:

1. There is no need to include in the flame detection apparatus any external voltage source, as is the case with the flame rod of the prior art and with the arrangements of the Bower and Aubert patents. As a consequence, the apparatus is significantly simplified and disadvantages, enumerated above, of applied voltage systems are avoided.

2. By monitoring a parameter of the flame emf which is intrinsically dependent on the presence of the flame and has a value substantially independent of flame connectivity and amplitude, normal flame fluttering does not adversely affect measurements. In consequence, delays are no longer required to prevent false alarms and the response time may therefore be much shorter than hitherto achievable.

3. The life of the pilot burner is almost indefinite and therefore the method by which the pilot or another secondary flame is used to provide the electrically conductive contact with the main flame is not subject to deterioration of the detection equipment, as is the case with the conventional flame rod.

4. In the case of the elongate flame front conductor, its exposure is less than that of a conventional flame rod since it need be positioned to extend only a short distance into the flame and in such a way that significant cooling of the rod occurs by virtue of unburnt ambient temperature gases that are forced from the burner past the rod into the interior of the furnace. This is in direct contrast to the conventional flame rod which is subject to extremely high flame temperatures.

5. If necessary, it is practicable, in the absence of a substantial applied voltage, to cool the elongate conductor, such cooling being impractical in conventional flame rod systems.

6 The apparatus may be used not only to detect the presence or absence of the flame but also to determine the fuel to oxidant ratio and therefore the stoichiometry of the flame.

I claim:

1. A method of detecting the condition of a flame, comprising the steps of:

establishing a flame having an emf;

electrically conducting the emf generated by the flame as a signal to a sensor through an electrically isolated conductor means, and sensing with said sensor an electrical parameter which is a measure of said emf of the flame;

wherein said electrical parameter is a parameter selected for its intrinsic dependence on the presence of the flame and substantial independence of its value from the degree of connection of the flame with the conductor means and from an amplitude of the signal received at said sensor, and wherein the parameter selected is the ratio of the A.C. and D.C. signal levels at said sensor.

2. A method of detecting the condition of a flame, comprising the steps of:

establishing a flame having an emf;

electrically conducting the emf generated by the flame as a signal to a sensor through an electrically isolated conductor means, and sensing with said sensor an electrical parameter which is a measure of said emf of the flame;

wherein said electrical parameter is a parameter selected for its intrinsic dependence on the presence of the flame and substantial independence of its value from the degree of connection of the flame with the conductor means and from an amplitude of the signal received at said sensor, and wherein said conductor means is an auxiliary flame.

3. A method according to claim 2 wherein said auxiliary flame is generated by an auxiliary burner means which is electrically isolated from adjacent furnace walls and piping supplying combustion components to said auxiliary burner means.

4. A method of detecting the condition of a flame, comprising the steps of:

establishing a flame having an emf;

electrically conducting the emf generated by the flame as a signal to a sensor through an electrically isolated conductor means, and sensing with said sensor an electrical parameter which is a measure of said emf of the flame;

wherein said electrical parameter is a parameter selected for its intrinsic dependence on the presence of the flame and substantial independence of its value from the degree of connection of the flame with the conductor means and from an amplitude of the signal received at said sensor, and wherein said flame is fed by a mixture of combustion components and the method further comprises the step of controlling the proportions of components in said mixture to sustain the monitored flame emf between predetermined limits.

5. A method of detecting the condition of a flame, comprising the step of:

monitoring an electrical parameter which is a measure of a flame emf generated by said flame, wherein said flame emf is indicative of the condition of said flame, further wherein said monitoring step includes sensing said flame emf with an auxiliary flame functioning as an electrically isolated electrical conductor, and said electrical parameter is a parameter selected for its intrinsic dependence on the presence of the flame and the substantial independence of its value from the connectivity of the flame with the conductor means and from the amplitude of the signal received at the sensor.

6. In a furnace assembly including a housing forming a combustion chamber, means for defining a flame position in the chamber, first burner means for generating said flame, electrical conductor means in electrical contact with said flame during operation of the furnace assembly, and means for electrically isolating said electrical conductor means, the improvement comprising:

means coupled to said electrical conductor means for monitoring an electrical parameter which is a measure of said flame emf generated by said flame, said flame emf being indicative of the condition of the flame, wherein said electrical parameter is a parameter selected for its intrinsic dependence on the presence of the flame and the substantial independence of its value from the degree of connection of the flame with the conductor means and from the amplitude of the signal received at said means for monitoring, and wherein the parameter selected is the ratio of the A.C. and D.C. signal levels at said means for monitoring.

7. In a furnace assembly including a housing forming a combustion chamber, means for defining a flame position in the chamber, first burner means for generating said flame, electrical conductor means in electrical contact with said flame during operation of the furnace assembly, and means for electrically isolating said electrical conductor means, the improvement comprising:

means coupled to said electrical conductor means for monitoring an electrical parameter which is a measure of said flame emf generated by said flame, said flame emf being indicative of the condition of the flame, wherein said electrical parameter is a parameter selected for its intrinsic dependence on the presence of the flame and the substantial independence of its value from the degree of connection of the flame with the conductor means and from the amplitude of the signal received at said means for monitoring, and wherein said electrical conductor means comprises burner means for generating an auxiliary flame in electrical contact with the first-mentioned flame.

8. A furnace assembly according to claim 7 wherein said means for electrically isolating said conductor means isolates said burner means for generating an auxiliary flame from said housing and from piping supplying combustion components to the latter burner means.

9. In a furnace assembly including a housing forming a combustion chamber, means for defining a flame position in the chamber, first burner means for generating said flame, electrical conductor means in electrical contact with said flame during operation of the furnace assembly, and means for electrically isolating said electrical conductor means, the improvement comprising:

means coupled to said electrical conductor means for monitoring an electrical parameter which is a measure of said flame emf generated by said flame, said flame emf being indicative of the condition of the flame, wherein said electrical parameter is a parameter selected for its intrinsic dependence on the presence of the flame and the substantial independence of its value from the degree of connection of the flame with the conductor means and from the amplitude of the signal received at said means for monitoring, wherein said means for defining a flame position comprises an opening in said housing and said burner means includes a casing adjacent said opening, and wherein an elongate conductor projects through an electrically insulated aperture in said casing, which elongate conductor includes passages for circulating coolant fluid therethrough.

10. A method of detecting the condition of a flame, comprising the steps of:

establishing a main flame having an emf;

sensing the emf generated by the main flame with a sensor; and electrically conducting the emf from the main flame to the sensor through an electrically isolated auxiliary flame.

11. A method of detecting the condition of a flame, comprising the step of:

monitoring a flame emf generated by said flame, wherein said flame emf is indicative of the condition of said flame, further wherein said monitoring step includes sensing said flame emf with an auxiliary flame functioning as an electrically isolated electrical conductor.

12. In a furnace assembly including a housing forming a combustion chamber, means for defining a flame position in the chamber and first burner means for generating said flame, the improvement comprising:

electrical conductor means comprising burner means for generating a further flame in electrical contact with the first-mentioned flame during operation of the furnace assembly;

means for electrically isolating said electrical conductor means; and means coupled to said electrical conductor means for monitoring said flame emf generated by the first-mentioned flame, said flame emf being indicative of the condition of the flame.

13. A furnace assembly according to claim 9, wherein said elongated conductor projects in a longitudinal direction of the flame.

* * * * *

UNITED STATES PATENT AND TRADEMARK OFFICE

CERTIFICATE OF CORRECTION

PATENT NO. : 5,073,104

DATED : December 17, 1991

INVENTOR(S) : KEMLO

It is certified that error appears in the above-identified patent and that said Letters Patent is hereby corrected as shown below:

On the cover page, please add item [30], prior foreign application, --PH 2227/85, Australia, September 2, 1985--.

Signed and Sealed this

Sixth Day of July, 1993

*Attest:*

Michael K. Kirk

MICHAEL K. KIRK

*Attesting Officer*

*Acting Commissioner of Patents and Trademarks*